United States Patent [19]

Winkler et al.

[11] Patent Number: 4,847,976

[45] Date of Patent: Jul. 18, 1989

[54] METHOD OF PRODUCING A CORROSION PROTECTED CABLE INCLUDING A JACKET

[75] Inventors: Niklaus Winkler, Erlenbach; René Käser, Wettingen, both of Switzerland

[73] Assignee: Bureau BBR Ltd., Zurich, Switzerland

[21] Appl. No.: 84,861

[22] Filed: Aug. 13, 1987

[30] Foreign Application Priority Data

Aug. 19, 1986 [CH] Switzerland ..... 3345/86

[51] Int. Cl.[4] ..... B23P 19/04

[52] U.S. Cl. ..... 29/433; 29/458

[58] Field of Search ..... 29/241, 433, 458; 156/48, 294

[56] References Cited

U.S. PATENT DOCUMENTS

| | | | |
|---|---|---|---|
| 3,106,771 | 10/1963 | Spuro | 29/433 |
| 3,832,215 | 8/1974 | Franke, Jr. et al. | 156/48 X |
| 3,836,695 | 9/1974 | Strecker et al. | 156/48 X |
| 3,889,455 | 6/1975 | Portinari et al. | 156/48 X |
| 4,596,743 | 6/1986 | Brauer et al. | 156/48 X |

FOREIGN PATENT DOCUMENTS 3038898 10/1985 Fed. Rep. of Germany .

*Primary Examiner*—Timothy V. Eley
*Assistant Examiner*—Frances Chin

[57] ABSTRACT

In order to produce a corrosion protective stressing cable having a protective jacket a stressing element bundle is prefabricated in a first production step. Thereby, the individual wires anchored in an anchoring body are inserted in a correct order into and through a perforated plate, at which the corrosion protective mass is fed into the interstices between the individual wires. The wires are thereafter bundled in a forming body at a simultaneous distribution of the corrosion protective mass therein. In a second production step a protective jacket is pulled onto the prefabricated bundle. To this end the protective jacket is clamped at one of its ends in an application apparatus, by means of which the protective jacket is pulled over the bundle and simultaneously a corrosion protection mass is fed into the interstice between the outer surface of the bundle and the protective jacket. This allows a production of a relatively long cables at a relatively low temperature expenditure on structures.

2 Claims, 2 Drawing Sheets

METHOD OF PRODUCING A CORROSION PROTECTED CABLE INCLUDING A JACKET

BACKGROUND OF THE INVENTION

1. Field of the Invention

The present invention relates to a method of producing a corrosion protected supporting or stressing, respectively, cable having a protective jacket. The invention relates further to an apparatus for practicing such method.

2. Description of the Prior Art

A protection against corrosion of supporting or stressing cables, such as used, for instance, as anchoring cables is an extremely important matter. To this end such cables are not only provided with a protective jacket but also the interstices between such protective jacket and the cable proper as well as the interstices between the individual wires are provided with a corrosion protecting mass, such as a grease. The problem here encountered is how an effective filling of the annular space prevailing between the jacket and the cable can be arrived at during the application of this protective jacket. According to a generally known method disclosed in the German patent specification DE-PS No. 3 038 898 the protective jacket is filled completely with a corrosion protecting mass at least along a part of its entire length. This necessitates a pressure feeding tube having a length corresponding substantially to the length of such protective jacket, to which tube the corrosion protecting mass is fed into the inner space of the jacket. Furthermore, mentioned method necessitates feeding the cable into the protective jacket by means of a separate infeeding apparatus and the supply of the corrosion protecting mass is relatively difficult to control. This known method is intrinsic and difficult, specifically in case of long cables.

SUMMARY OF THE INVENTION

Hence, it is an object of the present invention to provide a simplified procedure. A further object is to produce a corrosion protected supporting or stressing cable having a protective jacket comprising the provision of a hose-like protective jacket on a prefabricated bundle of stressing elements by introducing the bundle into the protective jacket from one end thereof, which end of the protective jacket is held in an application apparatus, by means of which a corrosion protection layer is applied onto the surface of the bundle at the area of the mentioned end of the protective jacket, and moving the protective jacket relative to the bundle.

Preferably a prefabricated bundle of stressing elements is used therefor, whereby in order to prefabricate said bundle the stressing elements mounted at one of their ends in an anchoring body are led through a perforated plate, by means of which they are arranged in a spread out condition such that the corrosion protective mass can be introduced into the interstices provided, whereby the stressing elements are led thereafter through forming body, in which they are bundled at the simultaneous distributing of the mass which has been fed in previously. Accordingly it is possible to already fill the interstices between the individual stressing elements during a first operating step. This allows also a mounting of the anchoring body from the beginning, in which anchoring body the upset individual wires may be anchored.

A further object of the invention is to provide an apparatus for practicing the method set forth above, which apparatus comprises an application apparatus including a casing surrounding the bundle, which casing is provided at its reverse side with a clamping means for the protective jacket and at its front side with a seal which cooperates with the surface of the bundle, and which apparatus is provided further with an application chamber located between said clamping means and said seal. This allows now a pulling of the protective jacket over the bundle and an applying of the corrosion protective means by means of one and the same apparatus.

BRIEF DESCRIPTION OF THE DRAWINGS

The present invention will be more fully understood by reference to the following detailed description thereof, when read in conjunction with the attached drawings, and wherein.

DESCRIPTION OF THE PREFERRED EMBODIMENT

Figure 1:
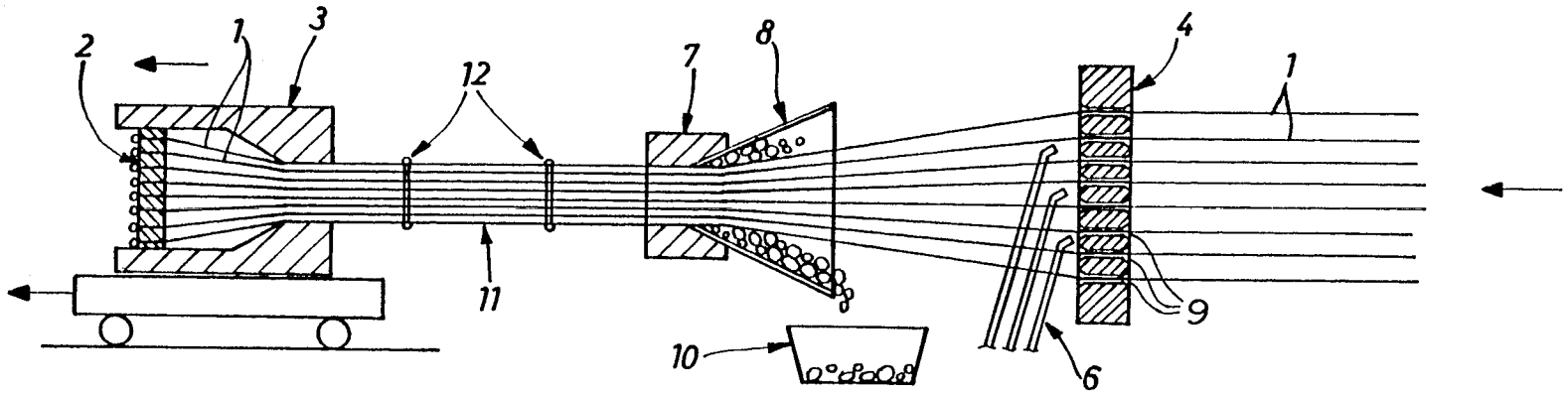
FIG. 1 illustrates schematically the phase of prefabricating the bundle.
Figure 2:
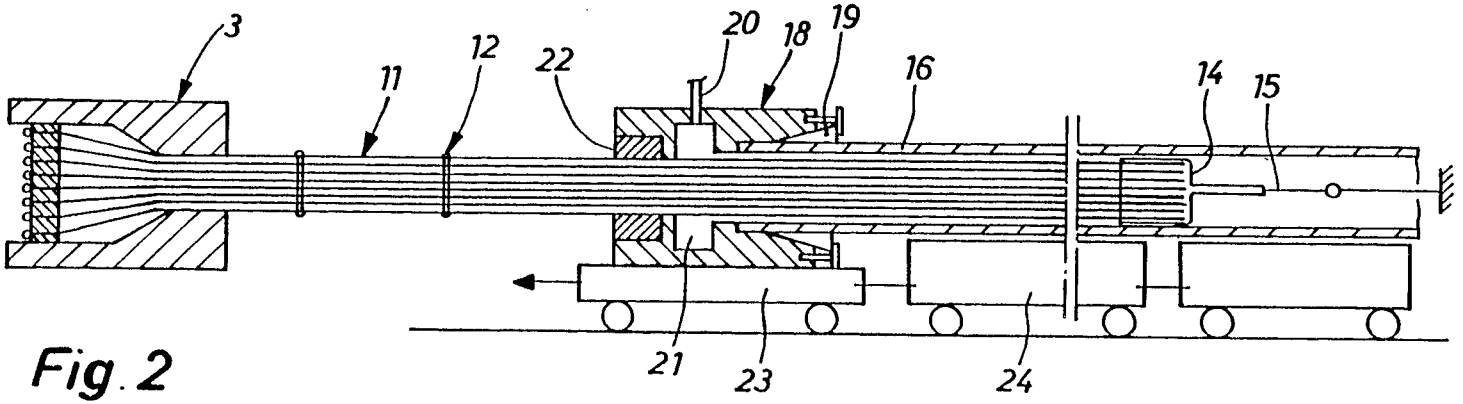
FIG. 2 illustrates schematically the applying of the protective jacket onto the prefabricated bundle.

During the prefabrication phase or step, respectively, such as illustrated schematically in FIG. 1 the stressing wires 1 are arranged initially in the correct configuration within an anchor plate 2 of an anchor body 3 and anchored by means of their upset heads. A perforated plate 4 made preferably of a plastic material is provided with through bores 9 distributed according to mentioned configuration, in which through bores 9 the stressing elements or wires 1, respectively, are guided. The stressing wires 1 pulled off (not particularly illustrated) spools are ordered in the perforated plate 4 in accordance with their position they will be at later in the cable and held in a spread out condition. By means of a plurality of feeding pipes 6 in a number corresponding to the number of wires and located at the reverse side of the perforated plate 4 grease is pressed into the interstices between the wires. Thereafter the ordered wires 1 are led through a forming body 7, in which they are taken together in a bundle-like manner, i.e. in which they are bundled. This forming body 7 has an inner shape which corresponds to the ideal shape of the closed wire bundle and comprises at one end a hopper shaped inlet 8. In this hopper shaped inlet the grease is pressed into the continuously decreasing interstices between the individual wires and distributed therearound. THE superfluous grease which is pressed out during this procedure is collected in a container 10. THe forming body 7 is basically a steel body having a plastic insert. THe prefabricated bundle 11 is provided at a location behind the forming body 7 with wire envelopes 12, which temporarily lock the bundle for maintaining its order of arrangement and shape. With the exception of a few supporting wires 15 the rear end of the bundle is provided for a fixing thereof with a shrink-hose-bandage 14 (see FIG. 2). The bundle 11 which has now been accordingly prepared is ready for the applying of the protective jacket 16. To this end this protective jacket 16 is pulled thereupon proceeding from the rear end of the bundle such that it does not disturb the anchoring body 3. Conversely, it would also be possible to draw the end of the bundle into the protective jacket 16, which latter would then be held unmovable. A can be clearly seen in FIG. 2, the bundle 11 is arrested during this phase by the supporting wires 15. THe protective jacket 16 is anchored against pulling forces at its front end within an application apparatus 18. Such can be arrived at, for instance, by means of wedge segments 19 or by means of a bolting of the application apparatus to the protective jacket 16. By means of a pump grease is fed via an infeed opening 20 to the application apparatus 18. This grease enters an application chamber 21, which surrounds in an annular manner bundle 11 and which is closed at its front end by means of a seal 22. Simultaneously the protective jacket 16 is pulled over the grease layer applied as explained above to which end the application apparatus 18 is mounted on a driven or pulled, respectively, carriage 23. The protective jacket is mounted or supported on a further carriage 24. Prior to the entry of the prefabricated bundle 11 into the application apparatus 18 the respective wire envelopes 12 are removed. The corrosion protective layer applied under pressure onto the surface of the bundle fills accordingly completely the interstice between the prefabricated bundle 11 and the protective jacket 16.

Figure 3:
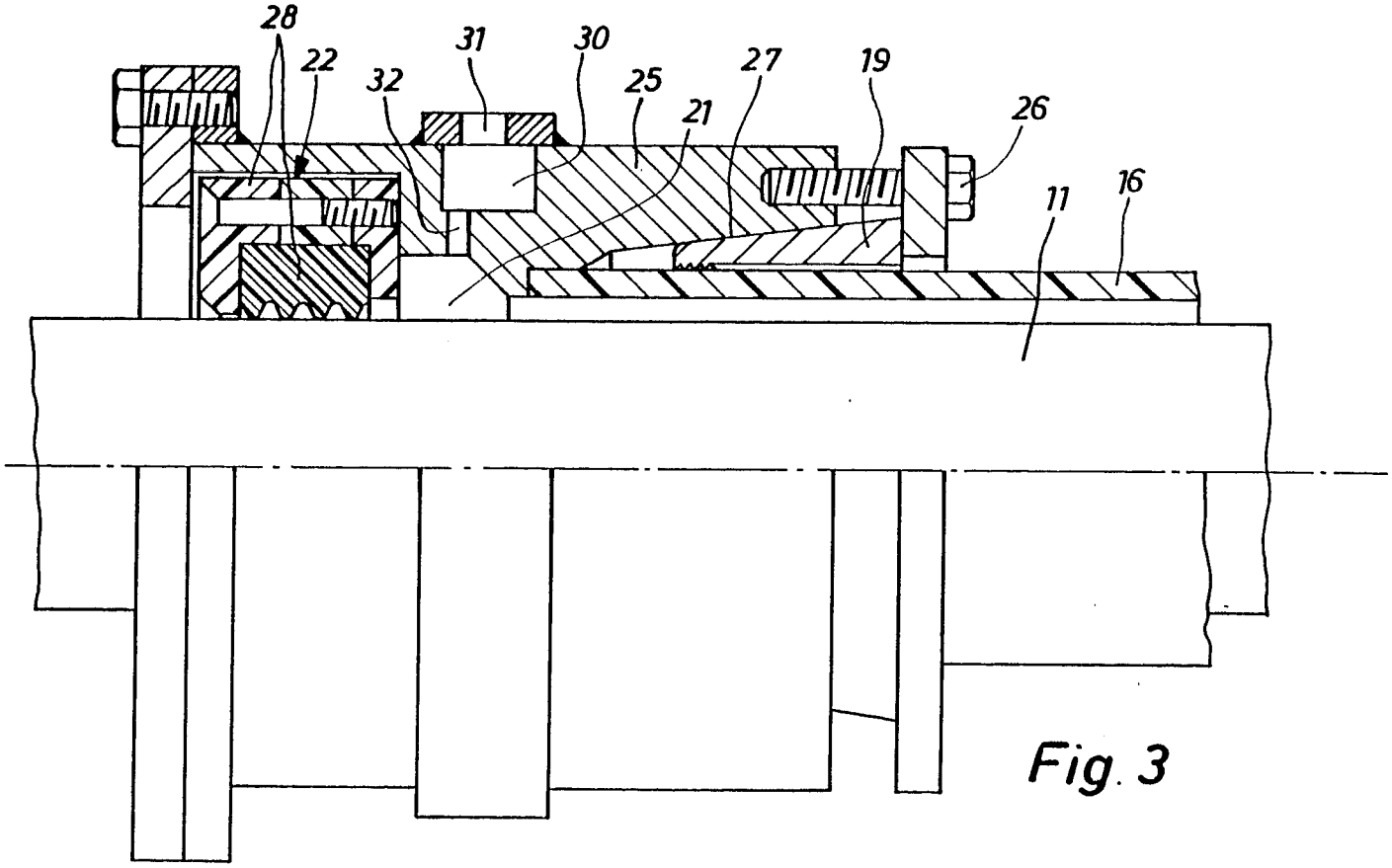
FIG. 3 illustrates schematically a view of a section of the application apparatus.

An embodiment of the application apparatus 18 will now be described in detail based on the illustration of FIG. 3. The application apparatus 18 has a casing 25 surrounding the bundle 11 in an annular-like fashion. Wedge segments 19 are mounted via tensioning bolts 26 at the reverse side of said casing 25, which wedge segments 19 are shiftable along wedge surfaces 27 such as to clamp the protective casing at its outer surface. A corresponding mounting can be arrived at also by a different procedure, e.g. by bolting the protective casing to the application apparatus by means of screw bolts.

A sealing body 22 is located at the front side of the casing 25. This sealing body 22 can have a disk-like shape and be supported rotatable within the casing. Specifically sealing elements 28 may be provided, which abut the outer surface of the bundle and adjust themselves to its shape and extent. An application chamber 21 is formed within the casing, which chamber 21 extends annularly around bundle 11. The application chamber 21 narrows down in the direction towards the protective jacket 16 until a measure corresponding to its inner diameter such that a layer of grease is providable corresponding to the interstice between bundle 11 and inner diameter of the protective jacket 16, which grease layer is pressed into this interstice. A number, e.g. ten, radially extending channels 32 lead to the application chamber, which channels 32 are distributed along its circumference and connect the application chamber 21 to a manifold chamber 30, which forms also an annular space such that the grease entering through one given inlet 31 is distributed evenly and can be fed into the application chamber 21. The pump as well as the storage container for the corrosion protection mass are taken along by the application apparatus 18.

The disclosed apparatus allows specifically a producing of extremely long cables (e.g. 600 feet) at a reduced expenditure. Furthermore it is possible to mount the anchoring of the cable already at the beginning, i.e. during a phase, during which the individual wires can still be freely manipulated. Finally, no long feeding lines for feeding the corrosion protective mass are necessary, the corrosion protective mass can be fed continuously at the end of the protective jacket. The application apparatus acts thereby simultaneously as pulling apparatus for pulling the protective jacket over and onto the bundle.

While there is shown and described the present preferred embodiment of the invention, it is to be distinctly understood that the invention is not limited thereto, but may be otherwise variously embodied and practiced within the scope of the following claims.

We claim:

1. A method of manufacturing a supporting or stressing cable, comprising the steps of: prefabricating a cable of a predetermined outer diameter from a plurality of individual wires, said wires being respectively anchored at one end thereof in an anchoring body in a defined configuration; fixing said prefabricated cable at another end opposite said one end to a holding member; connecting an end of a protective jacket having an inner diameter larger than the outer diameter of the cable, to an application apparatus having a ring-shaped application chamber with a cable entrance opening and a cable outlet opening, both of sufficient size for passing therethrough said prefabricated cable; securing said end of said protective jacket within said cable outlet opening against withdrawal therefrom; introducing said prefabricated cable, with the other end first, through said cable entrance opening into said application apparatus, leaving a gap between said cable entrance opening and said cable introduced therein; sealing said gap; moving said application apparatus relative to said cable, leaving an annular space between said outer diameter of said cable and the inner diameter of said protective jacket; and continuously feeding a non-gaseous corrosion protective mass under pressure into said application chamber and through said cable outlet opening into said annular space such that said annular space is continuously filled with said corrosion protective mass as said application apparatus moves relative to said cable.

2. A method according to claim 1, wherein prefabricating said cable comprises the steps of: drawing said plurality of wires with their one ends anchored in said anchoring body through a perforated plate having a bore for each wire, said bores being arranged in a defined order to leave interstices between said wires; pressing a corrosion protective mass downstream of said perforated plate into said interstices between said wires; passing said plurality of wires through a body for forming said wires into said cable and for removing excess corrosion protective mass from said interstices between said wires; and providing said cable with wire envelopes to temporarily fix said wires in position relative to each other.

* * * * *